US009629402B2

(12) United States Patent
Albertyn

(10) Patent No.: US 9,629,402 B2
(45) Date of Patent: Apr. 25, 2017

(54) PROTECTIVE GLOVE

(71) Applicant: Omega Global, Inc., Ladera Ranch, CA (US)

(72) Inventor: Gregory Ian Albertyn, Ladera Ranch, CA (US)

(73) Assignee: Omega Global, Inc., Ladera Ranch, CA (US)

( * ) Notice: Subject to any disclaimer, the term of this patent is extended or adjusted under 35 U.S.C. 154(b) by 660 days.

(21) Appl. No.: 14/031,849

(22) Filed: Sep. 19, 2013

(65) Prior Publication Data

US 2014/0075639 A1 Mar. 20, 2014

Related U.S. Application Data

(60) Provisional application No. 61/703,649, filed on Sep. 20, 2012.

(51) Int. Cl.
*A41D 19/01* (2006.01)
*A41D 19/015* (2006.01)

(52) U.S. Cl.
CPC ..... *A41D 19/01505* (2013.01); *A41D 19/015* (2013.01); *A41D 2500/54* (2013.01)

(58) Field of Classification Search
CPC ..... A41D 19/015; A41D 19/01505; A41D 19/01576; A41D 2500/54
See application file for complete search history.

(56) References Cited

U.S. PATENT DOCUMENTS

| | | | | |
|---|---|---|---|---|
| 2,072,541 | A * | 3/1937 | Burnham | A41D 19/0006 174/55 B |
| 3,916,448 | A | 11/1975 | Hamel | |
| 4,094,014 | A | 6/1978 | Schroeder | |
| 4,272,849 | A | 6/1981 | Thurston et al. | |
| 4,371,988 | A * | 2/1983 | Berend | A41D 19/0058 2/161.6 |
| 4,766,612 | A | 8/1988 | Patton, Sr. | |
| 5,336,555 | A * | 8/1994 | Darras | A41D 19/01505 2/159 |
| 5,598,582 | A | 2/1997 | Andrews et al. | |
| 5,740,551 | A | 4/1998 | Walker | |
| 6,649,013 | B2 | 11/2003 | Jin et al. | |
| D608,978 | S | 2/2010 | Votel | |
| 9,198,474 | B1 | 12/2015 | Hacobian | |
| 2008/0263738 | A1* | 10/2008 | Shamis | A41D 19/01523 2/16 |

(Continued)

OTHER PUBLICATIONS

U.S. Appl. No. 61/605,135, filed Feb. 29, 2012, Hacobian.

*Primary Examiner* — Shaun R Hurley
*Assistant Examiner* — Andrew W Sutton
(74) *Attorney, Agent, or Firm* — Knobbe, Martens, Olson & Bear LLP

(57) ABSTRACT

A protective glove includes a glove body defining an interior space for, in use, receiving a hand of a user. The glove body can include a liner that is constructed from or includes a material that is compatible with a polymer or nitrile outer coating. A padding layer includes a closed cell foam material. A guard layer includes guard elements that cover at least a portion of a back-of-hand portion of the glove body and one or more finger portions of the glove body. The glove also includes a polymer or nitrile outer coating applied to the liner. Methods of making the disclosed protective gloves are also disclosed.

18 Claims, 5 Drawing Sheets

(56) References Cited

U.S. PATENT DOCUMENTS

| | | | | |
|---|---|---|---|---|
| 2009/0126074 | A1 | 5/2009 | Mattesky | |
| 2010/0071114 | A1 | 3/2010 | Jaeger | |
| 2015/0033801 | A1* | 2/2015 | Finzelberg | B29C 41/14 66/174 |

* cited by examiner

PROTECTIVE GLOVE

INCORPORATION BY REFERENCE TO ANY PRIORITY APPLICATIONS

Any and all applications for which a foreign or domestic priority claim is identified in the Application Data Sheet as filed with the present application are incorporated by reference under 37 CFR 1.57 and made a part of this specification.

BACKGROUND

Field of the Invention

The present disclosure relates to the field of protective gloves.

Description of the Related Art

Protective gloves can be designed to protect against physical damage, such as cuts, abrasions, punctures, and chemical damage, such as burns. Protective gloves are designed to balance mobility, flexibility and comfort. Preferably, a glove not only protects the worker but also allows him to continue to work with a minimum of discomfort and mobility restriction. Different fabrics and fibers can be used depending on the application of the glove. The gloves can be designed to comply with industry standards for abrasions, cuts, and punctures, such as ASTM F1790, ISO 13997, and EN 388. Additionally, it can be difficult to manufacture a chemically resistant glove that is also resistant to abrasions, cuts, and punctures.

BRIEF DESCRIPTION OF THE DRAWINGS

Certain features, aspects and advantages of the present protective glove will become more fully apparent from the following description, taken in conjunction with the accompanying drawings. Understanding that these drawings depict only some embodiments in accordance with the disclosure and are, therefore, not to be considered limiting of its scope, the disclosure will be described with additional specificity and detail through use of the accompanying drawings.

DETAILED DESCRIPTION

Figure 1B:
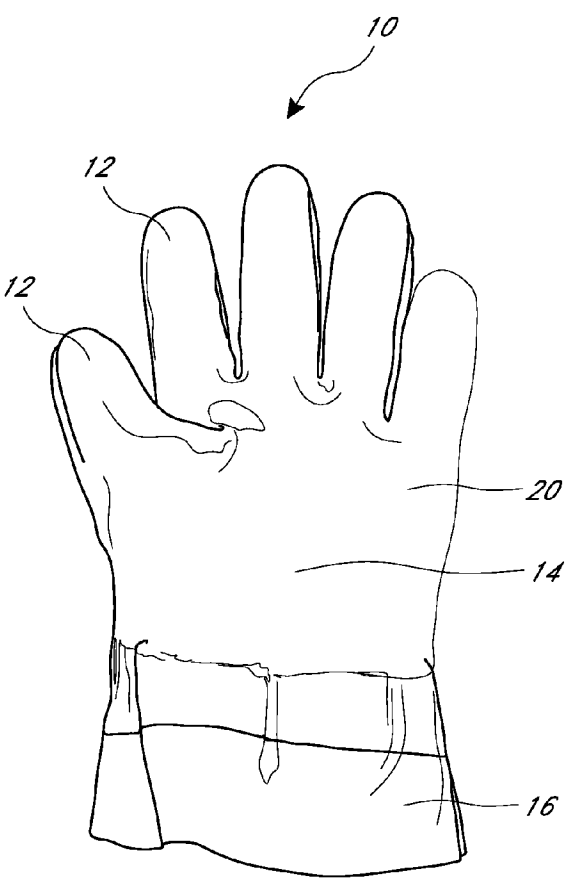
FIGS. 1A and 1B illustrate an embodiment of a protective glove.

In the following detailed description, reference is made to the accompanying drawings, which form a part hereof. In the drawings, similar symbols typically identify similar components, unless context dictates otherwise. The illustrative embodiments described in the detailed description and drawings are not meant to be limiting. Other embodiments may be utilized, and other changes may be made, without departing from the spirit or scope of the subject matter presented here. It will be readily understood that the aspects of the present disclosure, as generally discussed herein, and illustrated in the Figures, may be arranged, substituted, combined, and designed in a wide variety of different configurations, all of which are explicitly contemplated and made part of this disclosure.

In one embodiment, the present disclosure provides a protective glove that has a chemically resistant outer coating and a guard layer. In some arrangements, the guard layer is positioned within an inner lining and is configured to protect against physical harm, such as abrasions, cuts, and punctures. The guard layer can include protective elements, which can be secured to a base material. Different cut-resistant fibers and materials can be used in the inner lining or other portions of the glove that do not substantially restrict movement and can still provide increased dexterity without compromising protection. As noted, in some arrangements, coatings can be applied to the outer surface of a glove liner to provide chemical resistance.

Figure 1A:
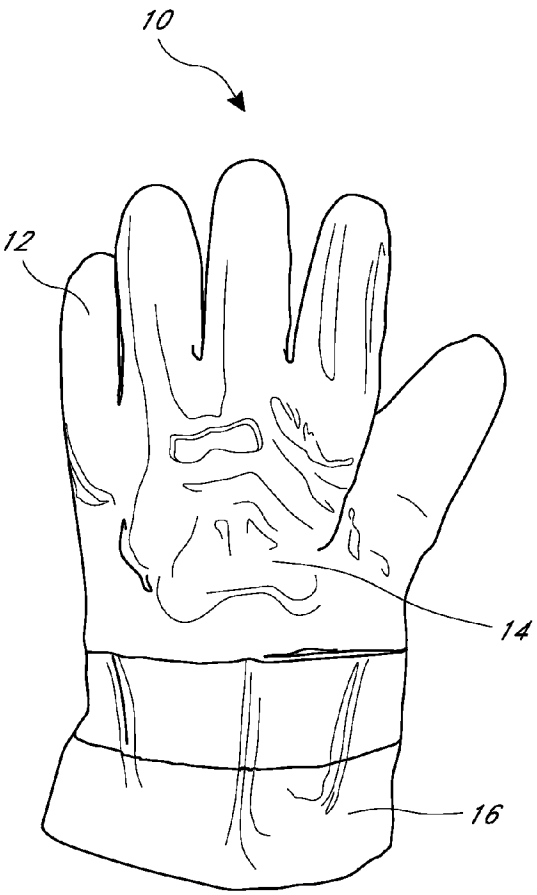
Figure 2:
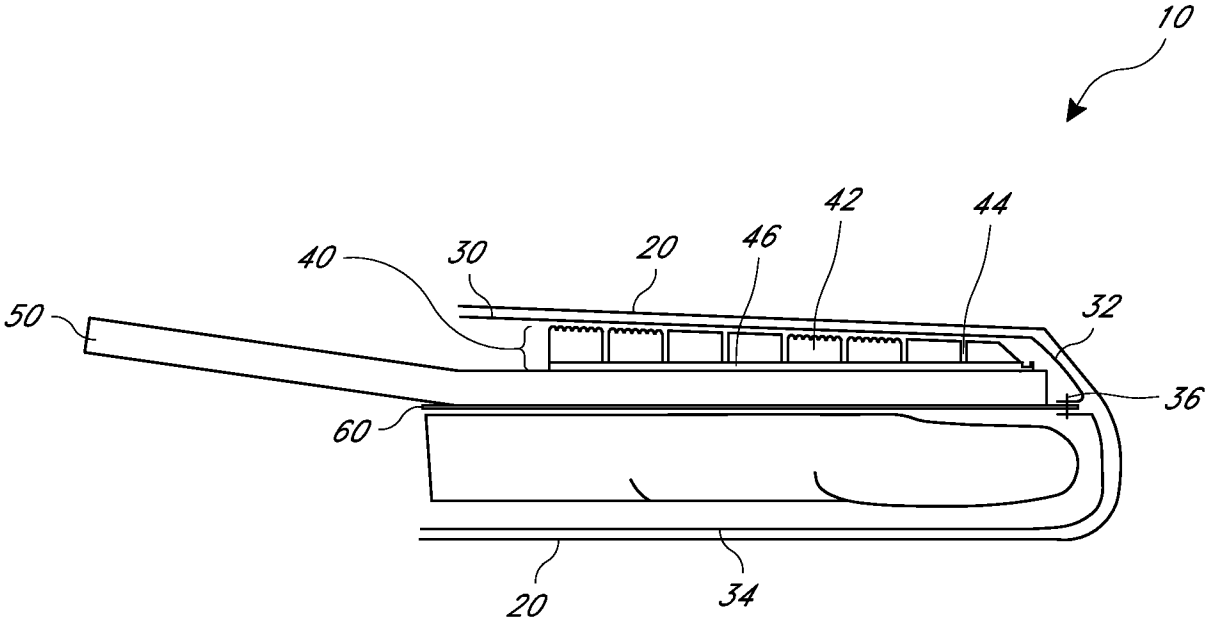
FIG. 2 illustrates a cross-section of a finger portion of the embodiment of the protective glove from FIG. 1.

FIGS. 1A, 1B, and 2 illustrate an embodiment of a protective glove 10. FIG. 1A is a view of the top side (back of hand side) of the protective glove 10. FIG. 1B is a view of the palm side of the protective glove 10. The protective glove 10 has a body comprising finger and hand portions. The finger portions 12 extend from the hand or base portion 14 and can collectively refer to both the fingers and thumb elements. The glove 10 can also include a cuff portion 16 that extends up the arm from the wrist. The cuff portion can be of any suitable length or shape.

FIG. 2 shows a layer profile of the protective glove 10 with a finger illustratively disposed within the glove 10. Preferably, the layer profile is substantially the same for the finger portions, thumb portion, and back of hand portion. The protective glove 10 has an outer coating layer 20, a glove liner 30, a protective guard layer 40, a padding layer 50, and an inner glove lining 60.

The outer coating 20 is a polymer coating that coats the glove liner 30. Preferably, the coating is a rubberized coating that can be formed from a wide range of polymer materials, such as nitrile polyvinyl chloride (PVC), polyurethane, latex, and the like. The outer coating 20 can have one or more layers that coat the glove liner 30. In this embodiment the protective glove 10 has at least two layers of the outer coating 20. The outer coating 20 can be chemically resistant. Preferably the gloves provide a continuous membrane that protects the hands from hazardous and non-hazardous substances. In one embodiment the glove can have two different polymer coatings. In some embodiments the outer coating 20 can help provide protection against abrasion, cuts, tears, and punctures.

Figure 3B:
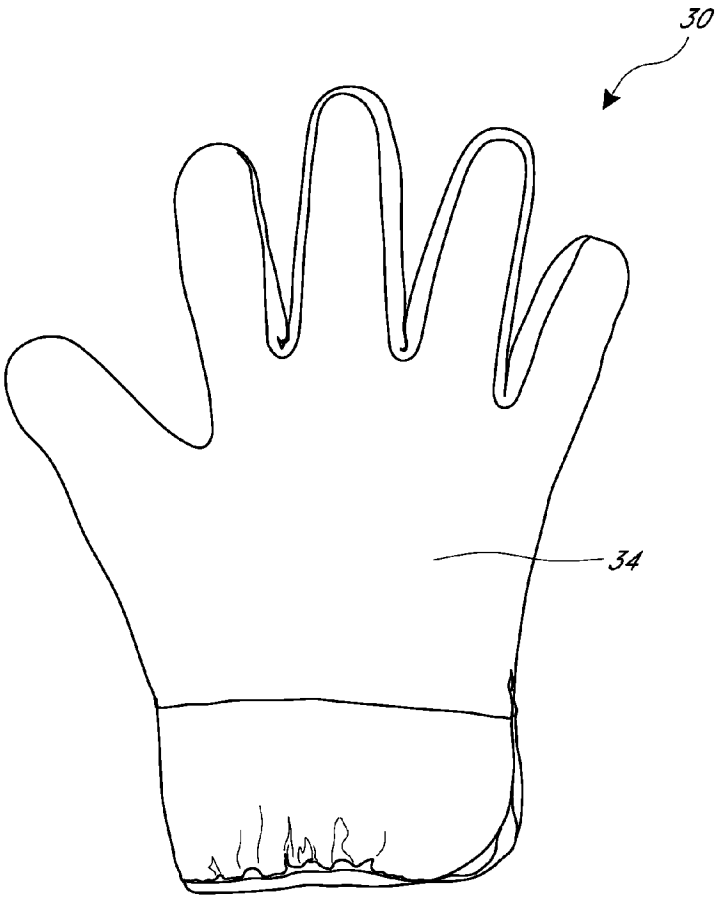
FIGS. 3A and 3B illustrates an embodiment of a glove liner for a protective glove.
Figure 3A:
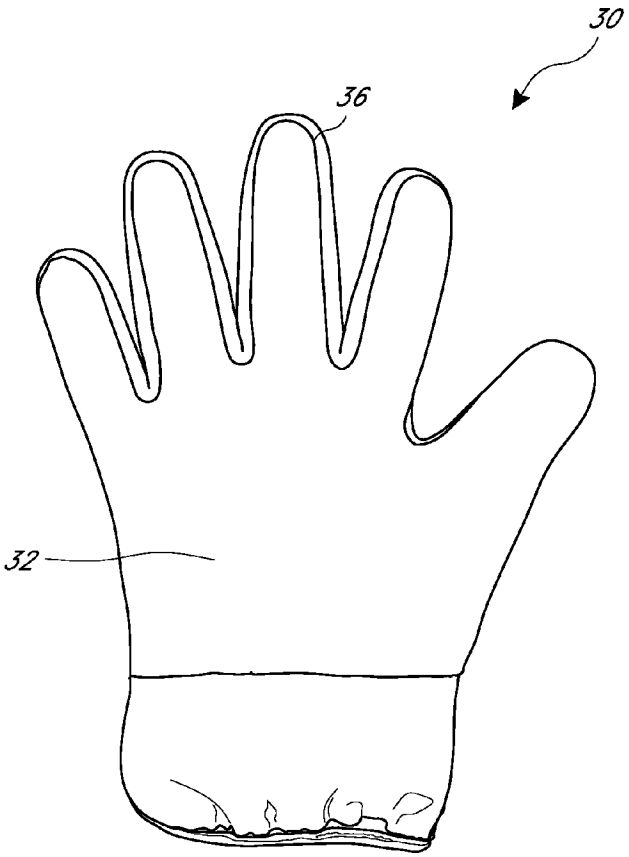

The glove liner 30 has finger portions, a top or back of hand portion 32, and a bottom or palm portion 34. The glove liner 30 can be made from many different materials, depending on the usage requirements of the glove 10, such as cut resistant materials, puncture resistant materials, fire retardant materials, and others. For example the glove liner can be manufactured from materials such as Dyneema®, Spectra®, Kevlar®, Kevlar/cotton/polyester blends, polyester and cotton blends, nylon, stainless steel mesh, leather, and other materials. FIGS. 3A and 3B illustrate an embodiment of the glove liner without the outer coating 20. In addition to any special or application-specific features, it is desirable that the liner 30 is constructed from or includes materials that can accommodate the outer coating 20. That is, preferably, the liner 30 is constructed from or includes materials commonly used in coated gloves, such as polymer or nitrile coated gloves, which possess desirable properties for accepting and retaining the particular outer coating 20 that is selected.

In one embodiment the outer coating 20 can be a nitrile coating. Nitrile is a synthetic version of latex that does not contain any latex proteins. Nitrile offers excellent resistance to punctures and tears, and can be three times more puncture resistant than rubber when used in gloves. Nitrile performs well in a range of temperatures between −4° C. (25° F.) and 149° C. (300° F.). Nitrile is chemically resistant and can provide protection against acids, bases, oils, solvents, esters, grease, and animal fats. Nitrile stands up especially well against oil, which can be good for handling small oily parts. In some embodiments, nitrile can be foamed when used as a palm coating, so that when in contact with smooth, oily surfaces, the foamed nitrile can behave like a sponge. Oil on the surface is soaked up, displacing it, which can improve grip considerably. Another foaming process uses micropore technology to create a bubbled surface, that will not allow oil to penetrate to the hand while absorbing it at the same time.

Figure 4:
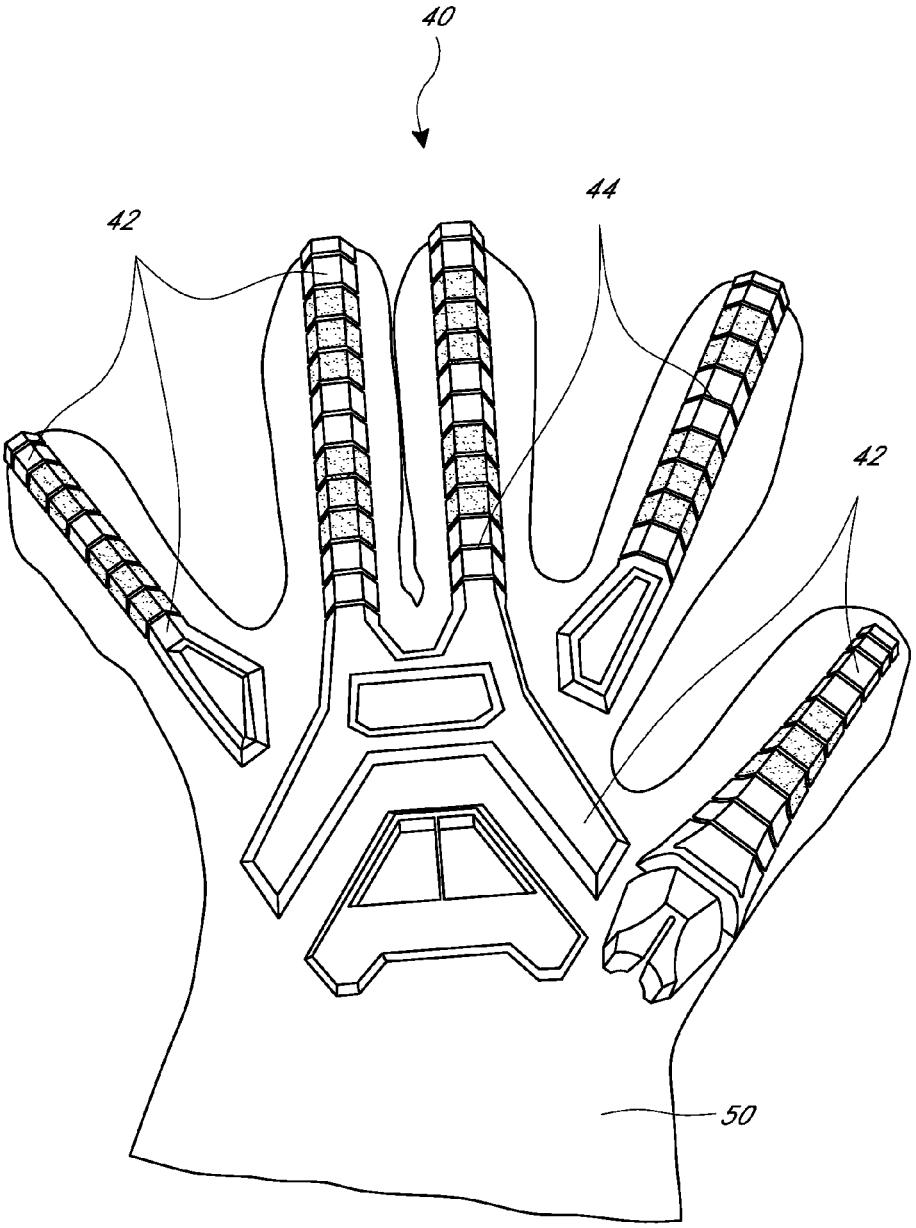
FIG. 4 illustrates an embodiment of a guard layer for a protective glove.

With additional reference to FIG. 4, the protective guard layer 40 is configured to be disposed on the top side of one, several or all of the fingers, thumb, and back of the hand. One embodiment of a guard layer 40 is shown in FIG. 4. The guard layer 40 has at least one and, preferably, a plurality of guard layer elements 42. The guard layer element(s) 42 can be a unitary formation (i.e., a single piece) or can be two or more separate pieces. The individual guard layer elements 42 can have gaps 44 formed therein to promote flexibility of the guard layer element 42. The elements 42 can be a plurality of shapes and sizes, and thicknesses. In some embodiments the thickness of the guard layer elements 42 can vary along the length of the finger portions. The guard layer 40 can be configured and arranged to substantially cover the back of the hand and the length of the fingers and thumb. In the illustrated arrangement, at least one guard layer element 42 covers both a portion of a finger (or thumb) area and a portion of the back-of-hand area. In particular, at least one guard layer element 42 covers a portion of the back-of-hand and the middle two fingers. Preferably, the guard layer elements 42 cover substantially an entirety of the middle two fingers. In addition, preferably, guard layer elements 42 of the outer two fingers also cover a portion of the back-of-hand area as well as the finger area. In the illustrated arrangement, the guard layer elements 42 of the outer two fingers covers only a small portion of the back-of-hand area (e.g., a transition portion or the knuckle area). The thumb guard layer element 42 can be similar to the outer finger elements 42 and covers both the thumb area and a portion of the back-of-hand area. Also, the illustrated guard layer 40 can include an element 42 that is solely positioned on the back-of-hand area.

As noted above, the guard layer elements 42 and/or gaps 44 can be configured to provide added mobility to the fingers, thumb, and hand. For example, the guard layer 40 can be formed from softer materials, such as rubber or a rubber-like material, or harder materials, such as carbon fiber. When harder materials are utilized, the gaps 44 can be relied on, in whole or in part, for mobility or flexibility. The gaps 44 can extend fully or partially through the thickness of the guard layer element 42. In some embodiments, the material, size, shape, arrangement and manufacturing methods used for the guard layer element(s) 42 can be the same as or similar to those used in gloves intended for use in motorcycle (e.g., motocross) or mountain biking applications.

In some embodiments the guard layer elements 42 are coupled to a base layer 46, which preferably forms a portion of the guard layer 40. Alternatively, the guard layer 40 can be attached directly to the padding layer 50. The guard layer 40 and/or base layer 46 can be sewn, heat bonded, or attached to the padding layer 50 by another appropriate means. In some embodiments (including those that may omit the padding layer 50), the top of the guard layer 40 can be coupled to the upper portion 32 of the glove liner 30 and/or the bottom of the guard layer 40 can be coupled to the glove lining 60. For example, the guard layer 40 can be adhered to the glove liner 30 or glove lining 60 with an adhesive. The glove liner 30 or glove lining 60 could also be sewn (or otherwise attached) to the base 46 of the guard layer 40. In addition, the guard layer 40 could be positioned within the liner 30 and/or lining 60 loosely or, at least, without physical means of attachment. For example, the liner 30 and/or lining 60 could create a "pocket" sized and shaped to receive and, preferably, substantially confine the guard layer 40 in a fixed position relative to the glove body. The guard layer 40 can be configured to provide abrasion resistance, cut resistance, impact resistance, and puncture resistance depending upon the material, positioning, thickness and overall configuration of the guard layer 40. For example a guard layer 40 formed from rubber can be configured to increase abrasion resistance of the protective glove. A preferred positioning of the guard layer 40 within the glove liner 30 can be seen in FIGS. 1A and 3A.

The padding layer 50 is arranged to protect any portion or an entirety of the back-of-hand and finger portions of the glove body. In one arrangement, the padding layer 50 is an integral (i.e., assembly) or unitary (i.e., single piece) member that covers a substantial entirety of the back-of-hand and finger portions of the glove body. The padding layer 50 preferably is a foam padding layer than can be any suitable thickness. Preferably, the padding layer 50 is between one and six millimeters of thickness. However, in alternative arrangements, the padding layer 50 can have a lesser or greater thickness depending on the application and/or level of protection desired. In some embodiments the padding layer 50 can have a constant thickness. In other embodiments the padding layer 50 can have variable thicknesses. For example, the finger portions could have a first thickness and the back of hand portion could have a second thickness. The first thickness could be less than the second thickness to promote flexibility of the finger portions. Alternatively, the first thickness could be greater than the second thickness to provide extra protection to the finger portions. In some arrangements, the padding layer 50 is positioned between the protective guard layer 40 and the inner glove liner 60. Preferably, in such an arrangement, the padding layer 50 is coupled to the inner glove lining 60. In one embodiment, the padding layer 50 is sewn to the inner glove lining 60. The protective guard layer 40 can be coupled to the foam padding layer 50 by any suitable arrangement, such as with an adhesive or stitching. The foam padding layer 50 preferably is made from or incorporates a closed cell foam, such as neoprene, EVA (ethyl vinyl acetate) foam, and other rubber-like foam materials. For example in one embodiment the padding layer 50 can be closed cell neoprene. Closed cell neoprene can offer protection from acids, alcohols, oils, solvents, esters, grease, and animal fats. Neoprene can be water resistant and water-proof. Neoprene can help facilitate or promote drying of the glove 10 during and/or after the manufacturing process.

Preferably, the inner glove lining 60 is positioned between the top portion 32 and the bottom portion 34 of the outer glove lining 30. The inner glove lining 60 can be sewn into position along the seam 36 between the top portion 32 and the bottom portion 34 of the glove lining 30. The inner glove lining 60 can be formed from any suitable material, such as the same material as the outer glove lining 30, a closed cell material, a foam material or other material. Preferably, the inner glove lining 60 is formed from a material that is comfortable for the hand. In some embodiments the inner glove lining 60 can be an insulated material that helps keep the hand warm during cold working conditions.

Figure 5:
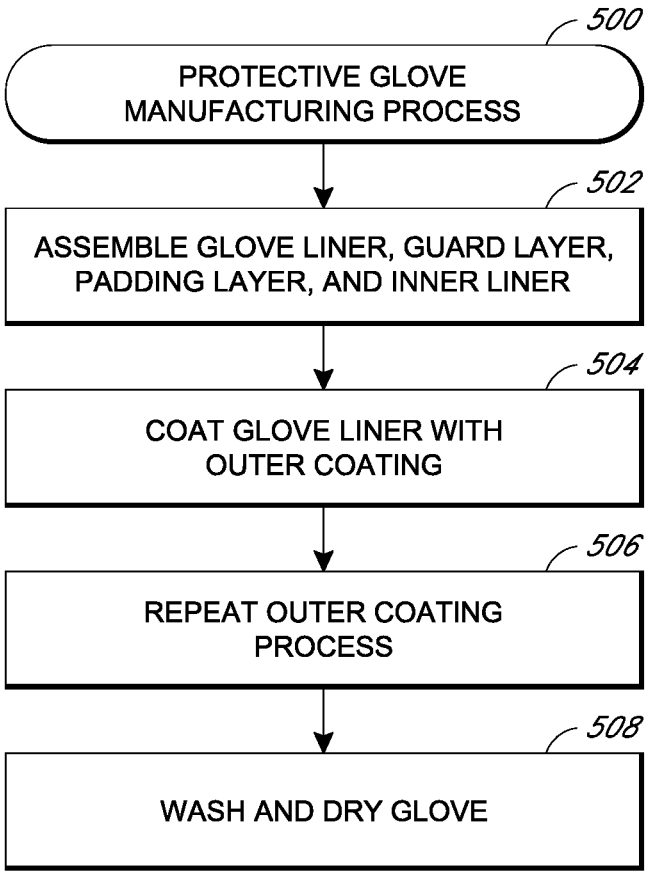
FIG. 5 illustrates an embodiment of a flowchart for a method of manufacture for a protective glove.

FIG. 5 is an illustrative flow chart showing a method of manufacture for a protective glove 500. At block 502 the protective glove 10 is assembled as desired, such as the arrangement shown in FIGS. 1, 2, 3A and 3B. The guard layer 40 can be coupled to the padding layer 50. The padding layer 50 can be coupled to the inner glove liner 60. The inner glove liner 60 can be coupled between the upper portion 32 and the lower portion 34 of the glove liner 30. In one embodiment, the inner glove liner 60 can be sewn into position between the upper and lower portions 32, 34.

At block 504 the glove liner 30 is coated with a polymer coating preferably in a polymer bath process. Preferably, the polymer bath is performed using an automated process. The glove liner 30 is positioned onto formers. In some embodiments the formers can be preheated prior to dipping the forms. The glove liner can be partially or fully dipped in a polymer bath. After being dipped in the polymer bath, the glove liner 30 can be dipped into a coagulant. The polymer coating can be vulcanized or cured. The curing process can vary for each polymer coating.

At block 506 the process for applying a polymer coating described with reference to block 504 can be repeated, if desired. The process can be used to apply two or more polymer coatings to the glove.

At block 508 the gloves can be washed and dried. The washing and drying process can be done after the polymer coating. As noted, the closed cell foam layer can help with the drying process so that the gloves can be completely dried after the washing process. Advantageously, the closed cell foam layer can facilitate the drying process to reduce the overall manufacturing time and/or allow the gloves to be completely or substantially completely dried after the washing process. The Applicants have discovered that many, if not all, open cell foam materials are difficult or impossible to fully dry—at least in the time frame afforded by a cost-effective manufacturing process. Accordingly, in some embodiments, a closed cell foam can provide advantages over an open cell foam for the padding layer 50 (if provided).

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

Similarly, this method of disclosure, is not to be interpreted as reflecting an intention that any claim require more features than are expressly recited in that claim. Rather, inventive aspects lie in a combination of fewer than all features of any single foregoing disclosed embodiment.

What is claimed is:

1. A protective glove, comprising:

a glove body defining an interior space for, in use, receiving a hand of a user, the glove body comprising:

a liner, the liner being constructed from or including a material that is compatible with a polymer or nitrile outer coating, the liner having a top layer and a bottom layer;

a padding layer comprising a closed cell foam material, the padding layer positioned between the top layer of the liner and the bottom layer of the liner;

a guard layer comprising guard elements that cover at least a portion of a back-of-hand portion of the glove body and one or more finger portions of the glove body, the guard layer positioned between the top layer of the liner and the padding layer;

a polymer or nitrile outer coating applied to the liner.

2. The protective glove of claim 1, further comprising an inner glove lining positioned between the padding layer and a palm-side portion of the liner.

3. The protective glove of claim 1, wherein the padding layer covers a substantial entirety of the back-of-hand and finger portions.

4. The protective glove of claim 3, wherein the padding layer is a unitary member.

5. The protective glove of claim 3, wherein the entire padding layer is an integrated member.

6. The protective glove of claim 1, wherein the guard layer is secured to the padding layer.

7. The protective glove of claim 1, wherein the guard elements are constructed from or include a rubber material.

8. The protective glove of claim 7, wherein the guard layer further comprises a base layer.

9. A method of manufacturing a protective glove, comprising:

forming a liner of a glove body that defines an interior space for, in use, receiving a hand of a user, from or including a material that is compatible with a polymer or nitrile outer coating, the liner having a top layer and a bottom layer;

providing a padding layer comprising a closed cell foam material, the padding layer positioned between the top layer of the liner and the bottom layer of the liner;

providing a guard layer comprising guard elements that, once assembled, cover at least a portion of a back-of-hand portion of the glove body and one or more finger portions of the glove body, the guard layer positioned between the top layer of the liner and the padding layer;

securing the padding layer and guard layer to or within the liner; and applying a polymer or nitrile outer coating to the liner.

10. The method of claim 9, further comprising providing an inner glove lining positioned between the padding layer and a palm-side portion of the liner.

11. The method of claim 9, further comprising forming the padding layer to cover a substantial entirety of the back-of-hand and finger portions.

12. The method of claim 11, further comprising forming the padding layer as a unitary member.

13. The method of claim 11, further comprising forming the entire padding layer as an integrated member.

14. The method of claim 9, further comprising securing the guard layer to the padding layer.

15. The method of claim 9, further comprising partially or fully constructing the guard elements from a rubber material.

16. The method of claim 15, further comprising providing a base layer that interconnects the guard elements of the guard layer.

17. The protective glove of claim 1, wherein the individual guard elements have gaps between the elements.

18. The protective glove of claim 1, wherein the thickness of the guard elements vary along the length of the one or more finger portions.

* * * * *